United States Patent [19]

Kojima et al.

[11] Patent Number: 4,881,500

[45] Date of Patent: Nov. 21, 1989

[54] POPPET VALVE MADE OF CERAMICS

[75] Inventors: Takio Kojima; Masato Taniguchi, both of Aichi, Japan

[73] Assignee: NGK Spark Plug Co., Ltd., Nagoya, Japan

[21] Appl. No.: 274,908

[22] Filed: Nov. 22, 1988

[30] Foreign Application Priority Data

Dec. 4, 1987 [JP] Japan ..... 62-307951

[51] Int. Cl.[4] ..... F01L 3/00

[52] U.S. Cl. ..... 123/188 AA; 29/156.7 R

[58] Field of Search ..... 123/188 AA; 29/156.7 R

[56] References Cited

U.S. PATENT DOCUMENTS

| | | | |
|---|---|---|---|
| 3,147,747 | 9/1964 | Kittlelson | 123/188 AA |
| 3,349,463 | 10/1967 | Kittelson | 29/156.7 R |
| 4,187,807 | 2/1980 | Cemenska et al. | 123/188 AA |

FOREIGN PATENT DOCUMENTS

| | | | |
|---|---|---|---|
| 367003 | 5/1920 | Fed. Rep. of Germany | 29/156.7 R |
| 923997 | 7/1947 | France | 29/156.7 R |
| 185540 | 10/1984 | Japan | 29/156.7 R |
| 302901 | 4/1971 | U.S.S.R. | 123/188 AA |
| 13285 | 6/1909 | United Kingdom | 123/188 AA |
| 489384 | 7/1938 | United Kingdom | 123/188 AA |

*Primary Examiner*—E. Rollins Cross

*Attorney, Agent, or Firm*—Foley & Lardner, Schwartz, Jeffery, Schwaab, Mack, Blumenthal & Evans

[57] ABSTRACT

An inclined surface of a valve head extending between a valve stem and a valve seat contacting portion has an annular portion in the place intermediate between the valve steam and the valve seat contacting portion. The inclined surface is ground at the annular portion only.

5 Claims, 3 Drawing Sheets

POPPET VALVE MADE OF CERAMICS

BACKGROUND OF THE INVENTION

1. Field of the Invention

The present invention relates to poppet valves made of ceramics, particularly of the kind used as intake and exhaust valves for an internal combustion engine.

2. Description of the Prior Art

In order to attain a high speed and high output of an internal combustion engine, it has recently been proposed to form the intake and exhaust valves from ceramics as silicon nitride, sialon, etc. which is excellent in rated strength, heat resisting property and sliding property.

In case of forming the intake and exhaust valves from ceramics, it is important from the point of view of the number of manufacturing processes and manufacturing cost to reduce the valve portions to be ground as much as possible. Due to this, it is considered to utilize the valve of which valve head inclined surface extending between the valve stem and the valve seat contacting portion is not ground but merely baked.

However, the unground or merely baked surface of the ceramic article is lower in strength as compared with the ground surface and therefore inferior in reliability to same. Furthermore, the valve head inclined surface is used under both mechanically and thermally servere conditions.

For this reason, the intake and exhaust valves made of ceramics have not made the best use of the lightweight feature and not fully used for attaining the high output of the internal combustion engine.

In order to solve the above described problem, it is considered to make the valve head thicker. This however increases not only the weight of the valve of itself but the resistance in feeding and scavenging the engine, thus reducing the output of the engine.

SUMMARY OF THE INVENTION

In accordance with the present invention, there is provided an improved poppet valve made of ceramics.

The poppet valve comprises a valve head having a valve seat contacting portion and a valve stem integral with the valve head. The valve head has an inclined surface extending between the valve head and the valve seat contacting portion. The inclined surface has an annular portion in the place intermediate between the valve stem and the valve contacting portion. The inclinded surface is ground at the annular portion only.

In one aspect of the invention, the annular portion is so shaped as to have inner and outer circumference which are concentric with the valve head and equidistance from a circle coinciding the middle points of generatrices by which the inclined surface is generated and as to have on a generatrix the width that is $\frac{1}{3}$ or $\frac{1}{2}$ of the length of the generatrix.

The above structure is effective for solving the above noted problems inherent in the prior art ceramic poppet valve.

It is accordingly an object of the present invention to provide an improved poppet valve made of ceramics which can reduce the ground surface of the valve head without reducing the strength.

It is another object of the present invention to provide an improved poppet valve of the above described character which can reduce the number of manufacturing processes and the manufacturing cost.

It is a further object of the present invention to provide an improved poppet valve of the above described character which can reduce the possibility that a flaw or flaws are formed in the ground surface.

It is a further object of the present invention to provide an improved poppet valve of the above described character which can reduce the resistances in feeding and scavenging of an associated engine.

It is a further object of the present invention to provide an improved poppet valve of the above described character which can improve the intake efficiency when used in an internal combustion engine.

DESCRIPTION OF THE PREFERRED EMBODIMENTS

Figure 1A:
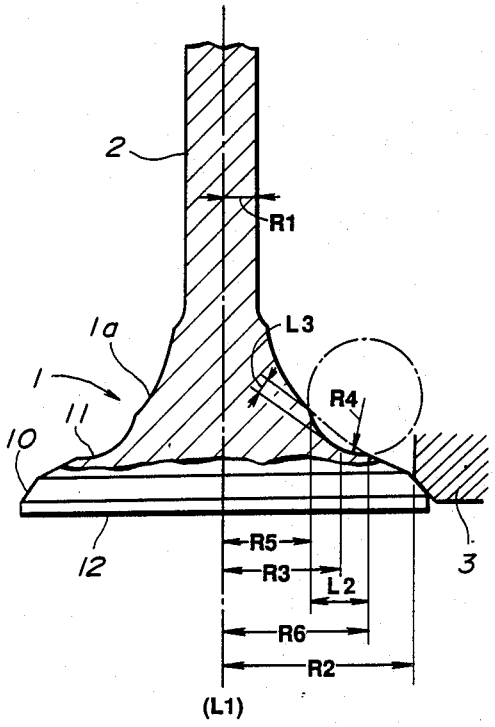
FIG. 1A is a fragmentary sectional view of a ceramic poppet valve according to an embodiment of the present invention.
Figure 1B:
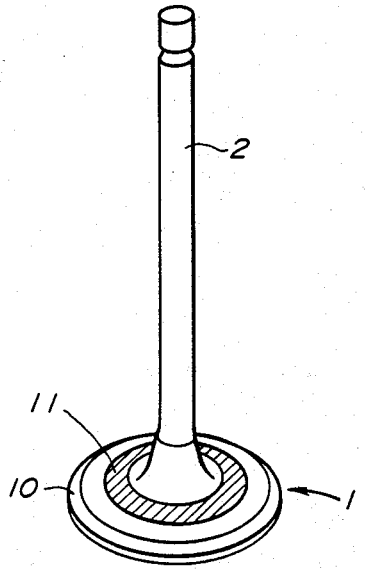
FIG. 1B is a reduced, perspective view of the ceramic poppet valve of FIG. 1.

Referring to FIGS. IA and IB, a poppet valve according to an embodiment of the present invention is made of ceramics and consists of a valve head 1 and a valve stem 2 integral with the valve head 1. The poppet valve is produced by forming ceramic powder containing 95 wt % of silicon nitride into a compact of a predetermined shape by injection molding or socalled rubber pressing and then baking or firing the compact. After that, the valve stem 2, a portion 10 for contact with a valve seat 3 and an annular portion 11 which will be described hereinafter and indicated by hatching in FIG. 1B are ground. The surface roughness of the valve stem 2 and the valve seat contacting portion 10 after grinding is about 2S (indication according to Japanese Industrial Standards). The surface roughness of the valve head 1 except for the valve contancting portion 10 and the annular portion 11 are smaller than 10S so that the valve head 1 does not become a heat source causative of an abnormal explosion.

The annular portion 11 is located in the middle of the inclined surface la extending between the joint of the valve head 1 and the valve stem 2 and the portion 10 for contact with the valve seat 3. Assuming that R1 is the radius of the valve stem 2 and R2 (>R1) is the distance between the center axis L1 of the valve head 1 and the valve seat 3, i.e., the radius of the valve seat contacting portion 10, the annular portion 11 in the form of a recess in this embodiment is so shaped as to have inner and outer circumferences which are concentric with the valve center line L1 and equidistant from a circle of which radius R3 is (R1+R2)/2 and also have the width L2 which is (R2−R1)/3 or (R2−R1)/2 when viewed on a plane including a bottom surface 12 of the valve head 1. In this embodiment, the anuular portion 11 is of a partcircular cross section of which radius is R4. In other words, the annular portion 11 is so shaped as to have inner and outer circumferences which are concentrric with the valve head 1 and equidistant from a circle coinciding the middle points of generatrices by which the inclied surface is generated and as to have on a generatrix the width that is $\frac{1}{3}$ or $\frac{1}{2}$ of the length of the generatrix.

More specifically, the annular portion 11 is shaped so that the radius R1 of the valve stem 2 is 3 mm, the distance R2 between the valve center axis L1 and the valve seat contacting portion 10 is 15 mm, the radius R3 of the annular portion 11 is 9 mm and the radius R4 of the part-circular cross section of the annular portion 11 is 5 mm. The raii R5 and R6 of the inner and outer circumferences of the annular portion 11 are respectively 7 mm and 11 mm, and therefore the width L2 of the annular portion 11 is 4 mm. Further, the maximum depth L3 of the ground annular portion 11 is 0.7 mm, and the surface roughness of the annular portion 11 is 2S or 3S. In the meantime, the transitting portion between the valve head 1 and the valve stem 2 is so ground as to constitute, when viewed in section, part of a circle of which radius is 5 mm.

The reason why the width L2 of the annular portion 11 is set to be (R2−R1)/3 or (R2−R1)/2 will be described hereinafter.

Figure 2:
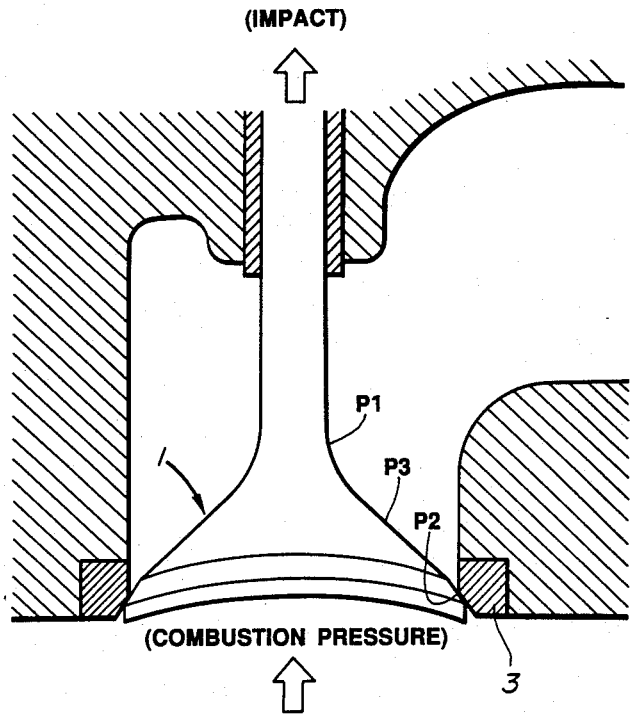
FIG. 2 is an exaggerated view depicting a valve head in a distorted condition due to stresses arising therein.
Figure 3:
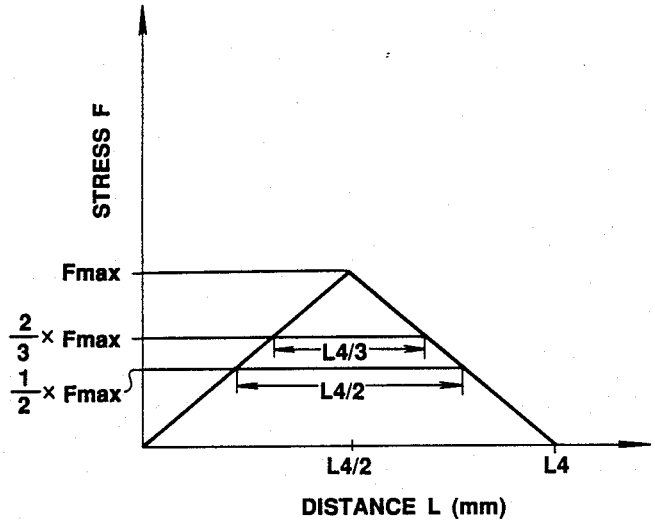
FIG. 3 is a graph of a relation between the stress F arising in the valve head inclined surface and the distance L by which a given position on the valve head inclined surface is spaced from the center axis of the valve.
Figure 4:
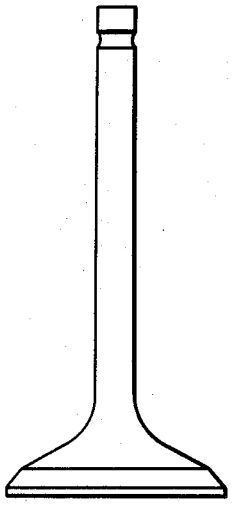
FIG. 4 (PRIOR ART)
FIG. 4 is a side elevational view of a prior art poppet valve which is not provided with an annular ground portion at a valve head inclined surface.

As shown in FIG. 2, an intake or exhaust valve of an internal combustion engine is subjected to large stresses resulting from a mechanical striking force or impact at the time of seating on the valve seat 3 and from the explosion or buring of the air-fuel mixture within the combustion chamber. On the other hand, the central portion of the valve head, i.e., the portion adjacent the valve center axis is thicker than the peripheral portion and therefore is less distored. Accordingly, the valve head is subjected to such a stress like a bending stress with two supports as shown.

The stress F acting on the inclined surface of the valve head 1 exibits a maximum value Fmax at the intermediate surface portion (point P3 in FIG. 2) and reduces as the position on the inclinded surface goes nearer to the point P1 or P2. In this connection, the relation between the distance L by which a given position on the inclined surface is spaced from the point P1 and the stress F is shown in the graph of FIG. 2. Usually, the strength of the merely baked surface is $\frac{2}{3}$ or $\frac{1}{2}$ of that of the ground surface. On the other hand, it will be understood from the graph that the inclined surface portion where the stress F is $\frac{2}{3}$ of the maximum value Fmax is so located as to center the intermediate portion of the inclined surface 1*a* and so extended as to have the width of L4/3. It will be further understood that the inclined surface portion where the stress F is $\frac{1}{2}$ of the maximum value Fmax is so located as to center the intermediate portion of the inclined surface 1*a* and so extended as to have the width of L4/2. In the meantime, L4 is the distance between the point P1 and the point P2, i.e., L4=(R2−R1).

The poppet valve of this embodiment is thus ground, other than at the valve stem 2 and the valve contacting portion 10, only at the annular portion 11 which is subjected to large stresses and distorted maximumly. By this, the valve can attain the strength which is equivalent to that of the valve of which inclined surface is grounded in its entirety. In this instance, the following table 1 shows a result of a test conducted under such a condition in which the ceramic valve of this invention is installed in an internal combustion engine of which allowable maximum rotation speed is 6,400 rpm and the engine is operated at the rotation speed of 9,000 rpm which is 1.4 times of the allowable maximum rotation speed. In the meantime, the number of the valves subjected to the above test is 10. Further, for comparison with the valve of this invention, there are provided a reference 1 which is formed so that the width L2 of the annular recess is 3 mm, a reference 2 which is formed so that the inclined surface is not ground in its entirety, and a reference 3 which is formed so that the inclinded surface is ground in its entirety.

TABLE 1

| | |
|---|---|
| the invention | no deffect is found in ten |
| reference 1 | one of 10 is broken at the rotation speed of 8,400 rpm |
| reference 2 | 8 of 10 are broken at the rotation speeds 7.600–8,800 |
| reference 3 | no deffect is found in ten |

From the table 1, it will be understood that the poppet valve of this invention can be sucessfully used in the internal combustion engine of the high speed and high output type, i.e., which is operated at the high rotation speed to produce a high output. In the meantime, another test was conducted under the condition that the ceramic valve of this invention was installed on a 2-liter, 4-cylinder engine and the engine was operated at the rotation speed of 7,000 rpm for 200 succesive hours. From this test, no deffect was found in the ceramic valve of this invention.

By the ceramic valve of this invention, it becomes possible to considerably reduce the valve surface necessitated to be ground. As a result, it becomes possible to reduce not only the number of manufacturing processes but the manufacturing cost.

Further, in case where the entire of the inclined surface of the valve head is ground, a grinder having a profile corresponding to that of the inclines suface is used. In this instance, the ground surface is liable to be damaged by a chipped portion of a grinding stone, thus reducing the strength of the ground surface. In this comparison, the ceramic valve of this invention can reduce the effective or working surface area of the grinding stone, thus enabling to reduce the possibility of the above described problem.

Further, the ceramic valve of this invention does not require to increase the thickness of the peripheral portion of the valve head or reinforce the same by means of ribs or the like, thus not reducing the intake and exhaust efficiency when used as intake and exhaust valves for an internal combustion engine but rather increasing the intake efficiency since by the povision of the annular ground portion 11 it becomes easier for the intake mixture to flow radially. By the experiments, it was found that as compared with the prior art ceramic valve which is not provided with an annular ground portion like this invention the valve of this invention increased the intake efficiency by 3–4%

Further, in this embodiment, the valve is ground so that the cross section of the annular portion 11 is formed into a part-cirular shape. By this, it becomes possible to eliminate any step formed at the transitting place between the ground portion and unground portion, thus making it possible to prevent a stress concentration in such a transitting place.

Figure 5:
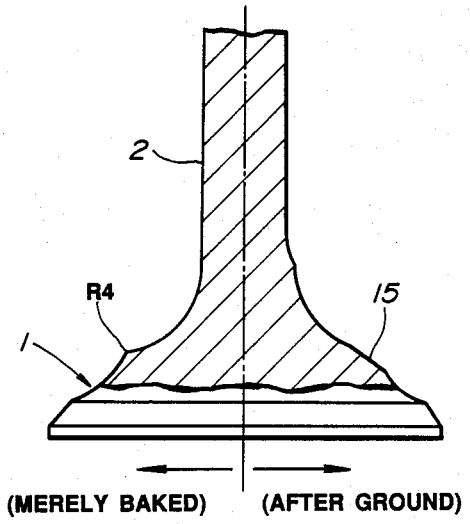
FIG. 5 is a ceramic poppet valve according to another embodiment of the present invention.

While the present invention has been described and shown as above, it is not limitative. For example, as shown in FIG. 5, the compact of the ceramic valve may be so shaped as to have a projected portion (point 4) after baking, which projected portion is ground to be flat for thereby forming an annular portion 15 into a circumference of a truncated cone. By this, it becomes possible not only to attain the foregoing effect but to reduce the difference in level between the ground surface and unground surface for thereby reducing a stress concentration more assuredly. Further, the cross section of the annular recess is not limited to a part-circular shape of which radius is 5 mm but may be another part-circular shape of which radius is larger than 5 mm. Further, the ratio of the radius of the valve stem to the radius of the bottom surface of the valve head is not limited to that of the above described embodiment. However, it is preferable that the radius of the valve stem is designed so as to be 1/4.5 to 1/5.5 of the radius of the bottom surface 12 of the valve head 1.

What is claimed is:

1. A poppet valve made of ceramics, comprising:

a valve head having a valve seat contacting portion; and a valve stem integral with said valve head;

said valve head having an inclined surface extending between said valve head and said valve seat contacting portion;

said inclined surface having an annular portion in the place intermediate between said valve stem and said valve contacting portion;

said inclinded surface being ground at said annular portion only.

2. A poppet valve as set forth in claim 1 wherein said annular portion is so shaped as to have inner and outer circumferences which are concentric with said valve head and equidistant from a circle coinciding the middle points of generatrices by which said inclined surface is generated and as to have on a generatrix the width that is $\frac{1}{3}$ or $\frac{1}{2}$ of the length of said generatrix.

3. A poppet valve as set forth in claim 1 wherein said annular portion is in the form of an annular recess of a part-circular cross section.

4. A poppet valve as set forth in claim 1 wherein said annular portion is in the form of a circumference of a trancated cone and formed by removing a projected portion by grinding.

5. A poppet valve as set forth in claim 3 wherein said annular portion is so shaped as to have inner and outer circumferences which are concentric with said valve head and equidistant from a circle of which radius is $(R1+R2)/2$ and also have the width which is $(R2-R1)/2$ or $(R2-R1)/2$, where R1 is the radius of said valve stem and R2 is the radius of said valve seat contacting portion.

* * * * *